US008475538B2

(12) United States Patent
Baum et al.

(10) Patent No.: US 8,475,538 B2
(45) Date of Patent: Jul. 2, 2013

(54) METHOD FOR GENTLY AFTERTREATING DYED TEXTILES

(75) Inventors: Pia Baum, Weinheim (DE); Klaus Scheuermann, Limburgerhof (DE); Dieter Boeckh, Limburgerhof (DE)

(73) Assignee: BASF SE (DE)

( * ) Notice: Subject to any disclaimer, the term of this patent is extended or adjusted under 35 U.S.C. 154(b) by 337 days.

(21) Appl. No.: 13/058,112

(22) PCT Filed: Jul. 30, 2009

(86) PCT No.: PCT/EP2009/059893

§ 371 (c)(1), (2), (4) Date: Feb. 8, 2011

(87) PCT Pub. No.: WO2010/018073

PCT Pub. Date: Feb. 18, 2010

(65) Prior Publication Data

US 2011/0154582 A1 Jun. 30, 2011

(30) Foreign Application Priority Data

Aug. 11, 2008 (EP) ..... 08162153

(51) Int. Cl.
*C11D 3/00* (2006.01)

(52) U.S. Cl.
USPC ..... 8/115.51; 8/181; 8/115.54

(58) Field of Classification Search
USPC ..... 8/115.51, 181, 115.54
See application file for complete search history.

(56) References Cited

U.S. PATENT DOCUMENTS

| | | | | |
|---|---|---|---|---|
| 4,902,439 | A | 2/1990 | Abel et al. | |
| 5,536,884 | A | 7/1996 | Stoeckigt et al. | |
| 6,447,696 | B1 | 9/2002 | Takagi et al. | |
| 6,680,412 | B2 | 1/2004 | Gumbel et al. | |
| 7,595,291 | B2 | 9/2009 | Bittner et al. | |
| 2006/0116311 | A1 * | 6/2006 | Baum et al. | 510/475 |
| 2010/0035497 | A1 | 2/2010 | Sierakowski et al. | |
| 2010/0107345 | A1 | 5/2010 | Sierakowski et al. | |

FOREIGN PATENT DOCUMENTS

| | | |
|---|---|---|
| DE | 10036713 | 5/2001 |
| DE | 10321396 | 12/2004 |
| EP | 0287514 | 10/1988 |
| WO | WO-92/14808 | 9/1992 |
| WO | WO-01/77276 | 10/2001 |
| WO | WO-2004/050982 | 6/2004 |
| WO | WO-2006/097435 | 9/2006 |
| WO | WO-2006098730 | 9/2006 |
| WO | WO-2006/128796 | 12/2006 |
| WO | WO-2008/065185 | 6/2008 |
| WO | WO-2009/060059 | 5/2009 |
| WO | WO-2009/060060 | 5/2009 |
| WO | WO-2009/065805 | 5/2009 |
| WO | WO-2010/003934 | 1/2010 |

OTHER PUBLICATIONS

U.S. Appl. No. 12/739,747, Boeckh.
U.S. Appl. No. 12/740,050, Boeckh.
U.S. Appl. No. 12/743,754, Boeckh.

* cited by examiner

*Primary Examiner* — Eisa Elhilo
(74) *Attorney, Agent, or Firm* — Novak Druce Connolly Bove + Quigg LLP

(57) ABSTRACT

A process for aftertreating dyed and/or printed textiles to remove excess portions of colorants comprises utilizing an aqueous formulation comprising at least one graft copolymer having a hydrophilic main chain and also surfactants.

15 Claims, No Drawings

METHOD FOR GENTLY AFTERTREATING DYED TEXTILES

CROSS-REFERENCE TO RELATED APPLICATIONS

This application is a national stage application (under 35 U.S.C. § 371) of PCT/EP2009/059893, filed Jul. 30, 2009, which claims benefit of European application 08162153.4, filed Aug. 11, 2008.

BACKGROUND OF THE INVENTION

This invention relates to a process for aftertreating dyed and/or printed textiles to remove excess portions of colorants utilizing an aqueous formulation comprising at least one graft copolymer having a hydrophilic main chain and also surfactants.

Fibers composed of polyester are widely used raw materials for producing textile materials. Textiles composed of polyester fibers can be dyed in from aqueous baths by means of various dyeing processes and/or printed by means of suitable textile printing colors. For instance, polyesters can be exhaust dyed with disperse dyes at 120°-130° C.

After textiles have been dyed they are typically after-washed to remove any excess colorant from their surface, since unfixed dyes can lead to marking off of the textiles (unwanted transfer of color to another material). Moreover, unfixed dyes can cause discoloration of differently colored textiles in a washing or laundering operation.

The excess dye left on the surface can be removed for example by means of a reduction clear with hydrosulfite and NaOH at 60-70° C. Thereafter, the textile material is typically rinsed, from 1 to 3 times depending on the depth of shade. The last rinse bath is preferably used to set the pH of the textile material to 4-7 with acetic acid.

It is further known to reduction clear using hydroxymethanesulfinic acid or derivatives thereof. The disadvantage of this method is that it is not suitable for all dyes, particularly not for some hydroquinone derivatives.

A third known method comprises using surfactants for after-washing. But surfactants alone generally do not have a sufficient effect.

Further details of such after wash operations are represented for example in *Textile Dyeing*, in particular Chapter 7 *Dyeing of Polyester Fibers* and also *Textile Auxiliaries*, in particular capital 5.10 *Aftertreatment Agents to Improve Fastness*, each in Ullmann's Encyclopedia of Industrial Chemistry, Online Edition 2008, Wiley-VCH, Weinheim, N.Y. 2005.

Polypropylene is a polymer that is outstandingly useful for producing textile materials, but textiles composed of polypropylene fibers are very difficult to dye from aqueous baths because of the apolar character of polypropylene. It is therefore known to improve the post-extrusion dyeability of polypropylene from aqueous dyebaths by addition of suitable auxiliaries.

WO 2006/098730, for example, discloses a disperse-dyeable fiber comprising a mixture of a polyolefin with an amorphous, glycol-modified PET (PET-G). Maleic anhydride is preferably used as an additional auxiliary.

WO 2006/128796 discloses a process for dyeing polyolefins which comprises utilizing polyolefins blended with a block copolymer comprising at least one apolar block constructed essentially of isobutene units and also at least one polar block constructed essentially of oxyalkylene units. Polyesters and/or polyamides may be incorporated as auxiliaries in addition to the block copolymer.

Such textiles composed of doped polypropylene can be dyed similarly to polyesters.

However, with textiles composed of doped polypropylene there is a risk that the colored doped polypropylene can be at least partially decolorized by a strong reduction clear. Even a very weak reduction clear (2 g/l of hydrosulfite and 0.5 g/L of NaOH) is observed to result in a loss of depth of shade for the dyed textile.

BRIEF SUMMARY OF THE INVENTION

It is an object of the present invention to provide a gentle afterwash process which avoids decolorization of the textiles.

We have found that this object is achieved by a process for aftertreatment of dyed and/or printed textile materials comprising polyester and/or polypropylene fibers comprising treating said materials with an aqueous formulation of at least one anionic and/or nonionic surfactant (A) at a temperature of 20 to 100° C., wherein the aqueous solution further comprises at least one graft copolymer (B), said graft copolymer (B) comprising a straight-chain or branched, hydrophilic main chain comprising nitrogen and/or oxygen atoms and also side chains grafted thereon.

DETAILED DESCRIPTION OF THE INVENTION

The invention will now be described in detail.

The process of the present invention is carried out by aftertreating dyed and/or printed textile materials comprising polyester and/or polypropylene fibers with an aqueous formulation.

Textile Materials

The term "textile materials" shall comprise in principle any kind of textile material, such as fibers for textile use, for example filaments or staple fibers, and also intermediate or semi-finished articles such as for example yarns, wovens, knits, fibrous nonwoven webs or nonwovens. The term also comprehends finished articles, for example apparel pieces or home textiles.

The textile materials comprise polyester and/or polypropylene fibers. They may consist exclusively of polyester fibers and/or polypropylene fibers, but it will be appreciated that they can also be used in combination with other materials, for example polyamide fibers or natural fibers. A combination can take place at various fabrication stages. For instance, filaments composed of a plurality of polymers in a defined geometric arrangement can be produced at the melt-spinning stage. At the yarn-producing stage, fibers composed of other polymers can be incorporated, or fiber blends can be produced from staple fibers. It is further possible to process different yarns together and finally it is also possible for wovens, knits or the like that comprise polyester and/or polypropylene fibers to be bonded to chemically different wovens.

One preferred version comprises textile materials comprising polypropylene fibers comprising suitable additives for improving dyeability.

Suitable polypropylene varieties for producing fiber are known in principle to one skilled in the art. They comprise relatively high molecular weight, viscid products which are characterized as usual in terms of their melt flow rate (determined to ISO 1133). According to the present invention, at least one polypropylene having an MFR melt flow rate (230° C., 2.16 kg) of 0.1 to 60 g/10 min is used.

Polypropylene homopolymers can be used. But it is also possible to use polypropylene copolymers which, as well as the propylene, comprise small amounts of other comonomers. Suitable comonomers include in particular other olefins such as for example ethylene and also 1-butene, 2-butene, isobutene, 1-pentene, 1-hexene, 1-heptene, 1-octene, styrene or α-methylstyrene, dienes and/or polyenes. The proportion of comonomers in the polypropylene is generally not more than 20% by weight and preferably not more than 10% by weight. The comonomers are selected for identity and amount by one skilled in the art according to the properties desired for the fiber. It will be appreciated that a mixture of a plurality of different varieties of polypropylene can be used as well. The polypropylenes preferably have an MFR melt flow rate (230° C., 2.16 kg) of 1 to 50 g/10 min, more preferably of 10 to 45 g/10 min and for example of 30 to 40 g/10 min.

The amount of polypropylene is 80% to 99% by weight, based on the sum total of all constituents of the undyed fiber, preferably 85% to 99% by weight, more preferably 90% to 98% by weight and for example 93% to 97% by weight.

In one preferred embodiment of the present invention, the polypropylene fiber comprises 1% to 20% by weight of at least one polyester to improve dyeability. The at least one polyester may comprise customary PET having a melting point of 255 to 265° C. It may be particularly advantageous to use modified PET which includes additional soft segments and accordingly has a lower crystallinity and/or melting point. It may be particularly advantageous to carry out the present invention by using polyesters having a melting point of 50 to 200° C.

Polyesters having a lower melting point are obtainable by substituting aliphatic dicarboxylic acid units, in particular adipic acid units, for a portion of the terephthalic acid units in the PET for the synthesis of the polyesters. In addition or in lieu of this substitution, the ethylene glycol units can also be replaced by longer-chain diols, in particular $C_3$- to $C_6$-alkanediols, for example 1,4-butanediol or 1,6-hexanediol.

Preferred polyesters for carrying out the present invention include at least two different dicarboxylic acid units (X). They comprise at least 5 to 80 mol % of terephthalic acid units (X1) and also 20 to 95 mol % of units of aliphatic 1,ω-dicarboxylic acids (X2) having 4 to 10 carbon atoms. The total amount of (X1) and (X2) is at least 80 mol %, the % ages all being based on the total amount of all dicarboxylic acid units in the polyester.

The aliphatic 1,ω-dicarboxylic acid units (X2) may comprise for example succinic acid, glutaric acid, adipic acid or sebacic acid. Adipic acid is preferred.

Dicarboxylic acid units other than the dicarboxylic acid units (X1) and (X2) can be present in addition thereto. Other aromatic dicarboxylic acid units and/or cycloaliphatic dicarboxylic acid units are suitable for example. It will be appreciated that it is also possible to use mixtures of various dicarboxylic acid units.

Preferably, the amount of terephthalic acid units (X1) is 20 to 70 mol % and the amount of (X2) is 30 to 80 mol %. Preferably, the sum total of (X1) and (X2) is at least 90 mol %, more preferably at least 98 mol % and most preferably 100 mol %.

The diol units (Y) are selected from the group of aliphatic, cycloliphatic and/or polyether diols, the amount of aliphatic 1,ω-diols (Y1) present being 50 to 100 mol %, the % ages being based on the total amount of all diols.

Aliphatic diols having 4 to 10 carbon atoms (Y1) may comprise for example 1,4-butanediol, 1,5-butanediol or 1,6-hexanediol. Preferably, (Y1) comprises 1,4-butanediol.

Examples of polyether diols comprise diethylene glycol, triethylene glycol, polyethylene glycol or polypropylene glycol. Examples of cycloaliphatic diols comprise cyclopentane- or cyclohexanediols. It will be appreciated that it is also possible to use aliphatic diols which do not conform to the definition of (Y1). Examples comprise in particular ethylene glycol or propylene glycol.

The polyesters, as will be appreciated, may comprise still further components to fine-tune their properties. Examples comprise building units that include additional functional groups. Amino groups are to be mentioned here in particular. A further mention must go to building block components for chain extension.

Preferred polyesters of the kind mentioned have a melting point of 50 to 200° C. The melting point is preferably 60 to 180° C., more preferably 80 to 160° C., most preferably 100 to 150° C. and for example 110-130° C. The glass transition temperature is preferably 20-35° C., preferably 25-30° C., without any intention of the invention hereby being restricted thereto.

The number average molecular weight $M_n$ should be in general 5000 to 50 000 g/mol and preferably 10 000 to 30 000 g/mol. The range from 20 000 to 25 000 g/mol will be found particularly useful. The $M_w/M_n$ ratio is preferably in the range from 3 to 6, for example 4 to 5.

It may further be advantageous for the polyester to have an MFR melt flow rate of 2-6 g/10 min (ISO 1133, 190° C., 2.16 kg). A preferred mass density is 1.2-1.35 g/cm$^3$ and more preferably 1.22-1.30 g/cm$^3$. The preferred Vicat softening temperature is 75 to 85° C. and more preferably 78-82° C. (VST A/50, ISO 306). Further details of the production of such polyesters are disclosed in WO 2008/65185.

It will be appreciated that it is also possible for various polyesters to be used as additive. The amount of polyester is preferably in the range from 1% to 15% by weight, more preferably in the range from 2% to 10% by weight and for example in the range from 3% to 7% by weight.

As well as the polyester mentioned, the polypropylene which is preferably used may comprise as an additive additionally 0.1% to 10% by weight of at least one block copolymer comprising at least one apolar block having a number average molar mass $M_n$ of at least 200 g/mol and a polar block having a number average molar mass $M_n$ of at least 500 g/mol. The amount of block copolymer is preferably in the range from 0.2% to 6% by weight, more preferably in the range from 0.5% to 4% by weight and for example in the range from 0.75% to 3% by weight.

One preferred embodiment of the present invention comprises an apolar block constructed essentially of isobutene units and also an apolar block constructed essentially of oxyalkylene units and the average molar mass $M_n$, of which is at least 1000 g/mol. The oxyalkylene units preferably comprise ethylene oxide units. The block copolymers are preferably triblock copolymers having a central block of oxyalkylene units and two terminal blocks of isobutene, the blocks being bonded together via suitable linking units.

In general, the polar blocks each have an average molar mass $M_n$ of 1000 to 20 000 g/mol. $M_n$ is preferably in the range from 1250 to 18 000 g/mol, more preferably in the range from 1500 to 15 000 g/mol and most preferably in the range from 2500 to 8000 g/mol.

The apolar blocks each have in general an average molar mass $M_n$ of 200 to 10 000 g/mol. $M_n$ is preferably in the range from 300 to 8000 g/mol, more preferably in the range from 400 to 6000 g/mol and most preferably in the range from 500 to 5000 g/mol.

The block copolymers may comprise diblock, triblock or multiblock copolymers. Diblock and triblock copolymers are preferred, especially triblock copolymers having a central polar block and two terminal apolar blocks. Mixtures of diblock and triblock copolymers can also be used.

Further details of such block copolymers and their method of making are set out at length in WO 2006/128796 at page 4 to page 10.

The block copolymers mentioned cooperate synergistically with the polyester and effect particularly good dyeability. Preference is therefore given to an additive system comprising at least one polyester and also at least one block copolymer of the kind mentioned. But it is also possible to use just one polyester or only said block copolymer as an additive.

Incorporation of the additives into the undoped polypropylene and also the processing into fibers can be done according to methods known to one skilled in the art, for example by melt extrusion. Details are described for example WO 2006/128796 at pages 14 to 15.

Dyeing/Printing the Textile Materials

The textiles materials can be dyed and/or printed by following methods known in principle to one skilled in the art. Disperse dyes may preferably be used. A person skilled in the art knows what is meant by "disperse dye". Disperse dyes are dyes with a low solubility in water which are used in disperse, colloidal form for dyeing, in particular for dyeing fibers and textile materials. Details for dyeing and/or printing of textile materials are described for example in WO 2006/128796 at page 15 to page 20.

Aqueous Formulation for Aftertreatment

Aftertreatment according to the present invention utilizes an aqueous formulation of at least one anionic and/or nonionic surfactant (A) and also at least one graft copolymer (B). A formulation for treating textiles is frequently also referred to as a "liquor" in the field of textile technology.

The aqueous formulation used comprises essentially water as a solvent. Optionally, water-miscible solvents may be present as well, examples being alcohols such as methanol, ethanol or propanol. In the general case, the solvent comprises at least 80% by weight of water relative to the sum total of all solvents in the aqueous formulation, preferably at least 90% by weight, more preferably at least 95% by weight, and it is very particularly preferred to use only water as solvent.

Surfactants (A)

Component (A) of the formulation comprises at least one anionic and/or nonionic surfactant (A). Preference is given to using at least one nonionic surfactant. It will be appreciated that it is also possible to use mixtures of two or more different surfactants.

Examples of suitable nonionic surfactants comprise surfactants (A1) of the general formula (I) $R^1$—O—($CH_2$—CH($R^2$)—O)$_n$—H. Here n is a number from 3 to 25, preferably 4 to 15 and more preferably 5 to 10. $R^1$ is an aliphatic and/or aromatic, straight-chain or branched hydrocarbyl radical having 8 to 20 carbon atoms, preferably 10 to 18 carbon atoms and more preferably 12 to 16 carbon atoms. $R^1$ preferably comprises a straight-chain or branched, aliphatic hydrocarbyl radical. $R^1$ may comprise for example radicals derived from fatty alcohols or preferably oxo process alcohols. The $R^2$ radicals are each independently hydrogen or an alkyl radical having 1 to 6 carbon atoms, preferably hydrogen or methyl and more preferably hydrogen. When two or more different $R^2$ radicals are present, at least 60% and preferably at least 80% of the $R^2$ radicals should comprise hydrogen, this proportion being based on the total number of all $R^2$ radicals. Nonionic surfactants (A1) are commercially available.

Further examples of surfactants comprise low-sudsing, nonionic surfactants (A2). Such surfactants are known in principle to one skilled in the art.

Preferably, (A2) may comprise nonionic surfactants of the general formula (II) $R^1$—O—($CH_2$—CH($R^3$)—O)$_m$—$R^4$, where $R^1$ is as defined above. m is a number from 3 to 30, preferably 5 to 25 and more preferably 10 to 20. $R^3$ may comprise hydrogen or an alkyl radical having 1 to 6 carbon atoms, preferably hydrogen or methyl, in which case at least 60% and preferably at least 80% of the $R^3$ radicals, based on the total number of all $R^3$ radicals, comprise hydrogen. It is particularly preferred for $R^3$ to comprise hydrogen exclusively. The $R^4$ group comprises a group which is more hydrophobic than the group —($CH_2$—CH($R^3$)—O)$_m$— in the formula (II). $R^4$ may comprise for example a group —($CH_2$—CH($R^5$)—O)$_n$—H, where z is a number from 1 to 15, preferably 2 to 10. $R^5$ is hydrogen or an alkyl radical having 1 to 6 carbon atoms, preferably hydrogen, methyl or ethyl, with the proviso that at least 60% of the $R^5$ groups based on the total number of all $R^5$ groups comprise an alkyl radical having 1 to 6 carbon atoms. Preferably, $R^5$ comprises methyl. Such block copolymers are obtainable by alkoxylating the starter alcohol with ethylene oxide or alkylene oxide mixtures comprising at least 60 mol % of ethylene oxide, and further alkoxylating the resulting alkoxyalcohol in a second stage with propylene oxide and/or higher alkylene oxides or with alkylene oxide mixtures comprising at least 60 mol % of propylene oxide and/or higher alkylene oxides.

Further examples of $R^4$ comprise straight-chain or branched alkyl radicals having 1 to 20 carbon atoms, preferably 6 to 14 carbon atoms or groups of the formula —CO—$R^4$, where $R^4$ is as defined above. Such structures are obtainable by etherification or esterification of appropriate nonionic surfactants.

Further examples of low-sudsing nonionic surfactants are disclosed for example in WO 92/14808, WO 01/77276 or WO 2006/097435. Low-sudsing nonionic surfactants are commercially available.

Graft Copolymers (B)

The term "graft copolymers" is used in the usual sense for copolymers which have a straight-chain or branched polymeric scaffold (main chain) and also (grafted-on) side chains which branch therefrom and which because of their length can themselves be termed oligomers or polymers. The polymeric scaffold and the side chains are chemically different.

The straight-chain or branched main chain is hydrophilic. It includes nitrogen and/or oxygen atoms, which are preferably part of the main chain itself. The nitrogen and/or oxygen atoms of the main chain are separated from each other by groups comprising hydrocarbyl groups, preferably 2 to 4 hydrocarbyl groups. They may preferably comprise 1,2-ethylene, 1,2-propylene, 1,3-propylene, 1,2-butylene or 1,4-butylene groups.

One preferred embodiment of the present invention comprises a graft copolymer (B) comprising a graft copolymer (B1) having a main chain consisting essentially of alkylene oxide units, the main chain having a number average molecular weight $M_n$ of 300 to 60 000 g/mol, preferably 600 to 10 000 g/mol and more preferably 2000 to 8000 g/mol.

The term "essentially" here is to be understood as meaning that the main chain generally comprises at least 90 mol % of alkylene oxide units. These alkylene oxide units preferably comprise ethylene oxide and/or propylene oxide units, and generally at least 50 mol %, preferably at least 70 mol % and more preferably at least 90 mol % of the alkylene oxide units comprise ethylene oxide units. It is particularly preferable for the main chain to comprise polyethylene glycol.

The side chains consist essentially of ethylenically unsaturated monomers. The ethylenically unsaturated monomers preferably comprise functional groups. Suitable monomers comprise vinyl derivatives or acrylic derivatives such as for example vinyl acetate, vinylamine, vinylpyrrolidone, vinylimidazole, vinyl esters, acrylic acid or acrylic esters. In one preferred embodiment of the present invention, the ethylenically unsaturated monomers of the side chains comprise at least 50 mol % of vinyl acetate, preferably at least 80 mol % of vinyl acetate and more preferably exclusively vinyl acetate.

The graft copolymers (B1) are obtainable in a conventional manner by conducting the polymerization of the ethylenically unsaturated monomers of the side chains in the presence of polyalkylene oxides, in particular polyethylene glycol. The quantitative ratio of polyalkylene oxides to ethylenically unsaturated monomers is preferably so chosen that the graft copolymer comprises 30% to 80% by weight of polyalkylene oxide, preferably 30% to 50% by weight of polyalkylene oxide.

It is particularly preferred for (B1) to comprise a graft copolymer of polyethylene glycol and vinyl acetate with 30% to 50% by weight of polyethylene glycol, the main chain having a number average molecular weight $M_n$ of 4000 to 8000 g/mol.

In a second preferred embodiment of the present invention, the graft copolymer (B) comprises a graft copolymer (B2) having a main chain consisting essentially of alkyleneimine units and having a number average molecular weight $M_n$ of 300 to 10 000 g/mol, preferably 300 to 1000 g/mol. The main chain preferably comprises polyethyleneimine and more preferably highly branched polyethyleneimine as typically obtained in the polymerization of ethyleneimine. The side chains comprise polyether units. Such graft copolymers (B2) are obtainable in a conventional manner by alkoxylation of polyethyleneimine, in particular with ethylene oxide, propylene oxide, butylene oxide or mixtures thereof, preferably ethylene oxide and/or propylene oxide. When various alkylene oxides are used, these may be present as random copolymers or else as block copolymers. The number of grafted-on alkylene oxide units is generally in the range from 5 to 100 per side group preferably 5 to 50.

Further Components (C)

The aqueous formulation, as well as the components (A) and (B), may optionally comprise still further components (C) as auxiliaries. Examples of such components comprise foam suppressants, wetting and deaerating agents or dispersants.

In one preferred embodiment of the present invention, the aqueous formulation further comprises at least one foam suppressant (C1). Foam suppressants based on polysiloxanes are suitable for example, examples being polydimethylsiloxanes. Preference is given to silicon-free foam suppressants such as fatty alcohol derivatives, disperse silica or polyethers such as polypropylene glycol, poly-(propylene glycol-ethylene glycol) copolymers or polypropylene glycol derivatives. In a further preferred embodiment of the present invention, the aqueous formulation further comprises at least one wetting auxiliary (C2). Examples of wetting auxiliaries comprise primary, secondary or tertiary phosphoric esters of alcohols, for example phosphoric esters of 2-ethylhexyl alcohol. Similarly, sulfosuccinates or further small-molecular surfactants can be used.

It is particularly preferred for the formulation to comprise at least one foam suppressant (C1) and at least one wetting auxiliary (C2).

The concentrations of the components of the formulation are determined by one skilled in the art according to the properties desired for the formulation.

The concentration of surfactants (A) in the formulation is generally in the range from 0.01 g/l to 5 g/l, preferably 0.02 g/l to 2 g/l, more preferably 0.05 g/l to 1 g/l and most preferably 0.1 g/l to 0.5 g/l.

The weight ratio of low-sudsing surfactants (A2) to the total amount of all surfactants should generally be at least 1:1.

The concentration of graft copolymers (B) in the formulation is generally in the range from 0.5 g/l to 10 g/l, preferably 0.1 g/l to 5 g/l, more preferably 0.2 g/l to 2 g/l and most preferably 0.3 g/l to 1 g/l.

In one preferred embodiment, the weight ratio of graft copolymers (B) to the surfactants (A) in the formulation is at least 1:1. The (B)/(A) weight ratio is preferably in the range from 1:1 to 20:1, more preferably in the range from 2:1 to 10:1 and for example in the range from 3:1 to 8:1.

The concentration of auxiliaries (C)—if present—is generally up to 5 g/l, preferably 0.01 g/l to 2 g/l, more preferably 0.02 g/l to 1 g/l and most preferably 0.05 g/l to 0.5 g/l.

It will be appreciated that it is also possible to prepare a concentrate first, which is appropriately diluted for use.

Process

The present process for aftertreating dyed and/or printed textile materials is part of the method of making textile materials and is generally carried out immediately following the dyeing and/or printing of the textile materials, typically in the dyehouse itself, although this is not meant to foreclose the possibility that the process may also be carried out at a later date. In general, the textile materials are washed after dyeing directly, i.e., without drying, in order that excess color may be removed from the textile. However, it is also possible first to dry and then to (after) wash.

The process of the present invention is carried out by treating the textile material with the aqueous formulation ("liquor"), for example by simple immersion. The weight ratio of aqueous formulation to textile materials ("liquor ratio") is generally in the range from 3:1 to 40:1, preferably 5:1 to 10:1.

The treatment temperature is generally in the range from 20 to 100° C., preferably in the range from 30 to 90° C. and more preferably in the range from 40 to 70° C. The aftertreatment time is generally in the range from 5 to 60 min, preferably in the range from 10 to 30 min and more preferably in the range from 15 to 25 min.

After treatment, the textile material is generally rinsed one or more times with water.

The process of the present invention has several advantages over reduction clearing, in particular in relation to the aftertreatment of textile materials comprising polypropylene: Excess color is removed from the surface of the fabric without significant deterioration in the depth of shade of the dyeing. The process thus acts at the surface only and does not penetrate into the interior of the fiber material. This is advantageous not only over reductive processes, but also over clearing with surfactants. Since these can be of low molecular weight, surfactants can penetrate into the interior of polymeric materials such as polypropylene for example and migrate back out together with dyes. There are also ecological advantages over the aftertreatment with hydrosulfite and NaOH in that neither hydrosulfite nor NaOH can pass into wastewater. In addition, formulations with hydrosulfite/NaOH inevitably have an alkaline pH, so that a neutralizing step is required after the aftertreatment. The formulations used according to the present invention are at most slightly alkaline, so that neutralization can be omitted.

The examples which follow illustrate the invention:

Textile Materials Used:

The tests were carried out with woven test fabrics composed of commercially available PET and also additized polypropylene.

The fabric of additized polypropylene was produced by the method described in WO 2006/128796. A polypropylene having a melt flow rate of 33 g/10 min (230° C., 2.16 kg) was used. The additive in the additized polypropylene comprises about 5% by weight of a polyester having a melting point of 94° C., prepared as per WO 2006/128796, page 33 and also about 1% by weight of a polyisobutene-polyethylene oxide-polyisobutene block copolymer (molecular weight $M_n$ of the blocks: about 1000-about 6000-about 1000), prepared as per WO 2006/128796, page 21 (block copolymer 2 example). The polypropylene and the additives were mixed together in a twin-screw extruder as per the procedure described in WO 2006/128796, page 17, spun into filaments and processed into a textile fabric.

The textile fabrics of PET and polypropylene were washed with a commercially available industrial laundry detergent before the dyeing tests.

Dyeing the Textile Materials:

Dyeing was carried out in an AHIBA® dyeing apparatus by following methods known in principle to one skilled in the art.

The particular dye used was weighed out, water was added and the bomb was heated for about 20 min in a hot waterbath at 60° C. until the dye had dissolved. After cooling to about 40° C., the remaining ingredients for the dyebath were added (4.8 g of a 5% solution of a commercially available wetting agent (Basojet® XP) in water, 75 g of a 1% solution of a UV stabilizer in water (Cibafast® PEX)) and the pH of the dyeing liquor was adjusted to 4.5 with a buffer solution (21 ml/l of glacial acetic acid and 30 g/l of sodium acetate). Total amount of formulation 200 ml in each case.

Each dyeing liquor was entered with 10 g of the textile sample, and the bomb was sealed and secured in the dyeing apparatus. The following temperature profile was used:

1. Fast to 130° C.
2. Hold at 130° C. for 30 minutes.
3. From 130° C. to 70° C. in 24 minutes=2.5° C./min After dyeing, the textile was removed and thoroughly rinsed through with hot water and after-rinsed with cold water. It was then whizzed and dried in a drying cabinet at 60° C. air circulation.

The polyester and polypropylene textiles were each dyed with commercially available dyes, namely a black disperse dye (Panacron® Black AM-B, 3% by weight in dyeing liquor), a red disperse dye (Dianix® Deep Red SF, 2% by weight in dyeing liquor) and a yellow disperse dye (Dianix® Flavine, 1% by weight in dyeing liquor).

Aftertreatment of Dyed Textiles

General Working Prescription:

Water is initially heated without additives to the desired temperature for aftertreatment. On attainment of the temperature the additives are added as a concentrate in aqueous solution so that the desired concentration becomes established and at the same time the textile sample is added. The textile sample is agitated in the formulation for the desired treatment time, after which the formulation is decanted off and the textile sample is rinsed with hot water and then with cold water.

The textile sample is then briefly rinsed in a solution of 0.5 l of water with 2 ml of concentrated acetic acid, hydroextracted and dried in a laboratory dryer for 2 min at 120° C. and 700 rpm.

Inventive Formulation F1:

Solution of the following components in water:

Surfactants (A):

| | |
|---|---|
| 0.05 g/l | Nonionic surfactant based on a $C_{13}$ oxo process alcohol, the alcohol was ethoxylated with 5 units of ethylene oxide |

-continued

| | |
|---|---|
| 0.05 g/l | Low-sudsing, nonionic surfactant based on a $C_{13}/C_{15}$ oxo process alcohol, the alcohol was ethoxylated with 12 units of ethylene oxide and then alkoxylated with a mixture of ethylene oxide and propylene oxide (ratio about 1:1, altogether about 10 units). |

Graft Copolymer (B):

| | |
|---|---|
| 0.6 g/l | Vinyl acetate-polyethylene glycol graft copolymer (obtained by polymerization of vinyl acetate in the presence of polyethylene glycol with $M_n$ about 6000 g/mol). Weight proportions: polyethylene glycol 40% by weight, vinyl acetate 60% by weight. |

Additives (C):

| | |
|---|---|
| 0.25 g/l | Defoamer (polypropylene glycol) |
| 0.4 g/l | Wetting agent (2-ethylhexyl phosphate) |

Comparative Formulation V1:

Solution of the following components in water:

| | |
|---|---|
| 2 g/l | $NaHSO_3$ |
| 0.5 g/l | NaOH |

Comparative Formulation V2:

Solution of the following components in water:

| | |
|---|---|
| 4 g/l | $NaHSO_3$ |
| 2 g/l | NaOH |

The formulation used for each treatment and the temperature and duration of the treatment are summarized in table 1 below. For each treatment, the depth of shade of the dyeing was assessed before and after. The change in color of the material is determined via the gray scale for assessing change in color (ISO 105-A02: 1993 DIN-EN 20105-A02 1994). Change in color is in each case reported on a scale from 1 to 5 (5: smallest change, 1: largest change).

Washfastness:

The washfastness of the aftertreated samples was carried out with a washfastness test to DIN ISO 105-C06-A1S without use Of steel balls.

In this test, the aftertreated fabric is washed at 40° C. At the same time as the dyed textile, white fabrics composed of other textile materials (wool, cotton, polyamide) are washed. The discoloration of the white fabric is assessed. The assessment is done against the gray scale for assessing staining (ISO 105-A03:1993 DIN EN 20105-A03:1994). The degree of staining is in each case assessed on a scale from 1 to 5 (5: least staining of adjacent fabric, 1: most staining of adjacent fabric).

The results are likewise presented in table 1.

In a second series of tests, the above-described textiles based on doped polypropylene fibers were dyed with 2% by weight of a blue disperse dye (Serilen® Dark Blue RT-LS 200). The dyed textiles obtained were aftertreated with $NaHSO_3$/NaOH under various conditions and also with the inventive formulation. The results are presented in table 2.

TABLE 1

Results of inventive and comparative examples

| No. | Textile | Dye | Aftertreatment Formulation | T [° C.] | Time | Color[1] | Washfastness test Color of test fabrics[2] Wool | Polyamide | Cotton |
|---|---|---|---|---|---|---|---|---|---|
| Inventive example 1 | PET | 3% black | F1 | 60° C. | 20 min | 5 | 4 | 4 | 4-5 |
| Inventive example 2 | PET | 2% red | F1 | 60° C. | 20 min | 5 | 4 | 4-5 | 4-5 |
| Inventive example 3 | PET | 1% yellow | F1 | 60° C. | 20 min | 5 | 4-5 | 4-5 | 5 |
| Inventive example 4 | Polypropylene | 3% black | F1 | 60° C. | 20 min | 4-5 | 4 | 2-3 | 4-5 |
| Inventive example 5 | Polypropylene | 2% red | F1 | 60° C. | 20 min | 4-5 | 3-4 | 4 | 4-5 |
| Inventive example 6 | Polypropylene | 1% yellow | F1 | 60° C. | 20 min | 5 | 4-5 | 4-5 | 4-5 |
| Comparative example 1 | PET | 3% black | V1 | 60° C. | 20 min | 5 | 4-5 | 4 | 4-5 |
| Comparative example 2 | PET | 3% black | V2 | 60° C. | 20 min | 5 | 4-5 | 4-5 | 4-5 |
| Comparative example 3 | Polypropylene | 3% black | V1 | 60° C. | 20 min | 4-5 | 4 | 2-3 | 4-5 |
| Comparative example 4 | Polypropylene | 3% black | V2 | 60° C. | 20 min | 4 | 4 | 3-4 | 4-5 |
| Comparative example 5 | Polypropylene | 2% red | V1 | 60° C. | 20 min | 4 | 3-4 | 4 | 4-5 |
| Comparative example 6 | Polypropylene | 2% red | V2 | 60° C. | 20 min | 3-4 | 4 | 4 | 4-5 |
| Comparative example 7 | Polypropylene | 1% yellow | V1 | 60° C. | 20 min | 4 | 4-5 | 4-5 | 4-5 |
| Comparative example 8 | Polypropylene | 1% yellow | V2 | 60° C. | 20 min | 3-4 | 4-5 | 4-5 | 4-5 |

Formulation 1: inventive,
V1: 2 g/l $NaHSO_3$/0.5 g/l NaOH;
V2: 4 g/l $NaHSO_3$/2 g/l NaOH
[1]Depth of color after afterwash: 5 best rating (small change in depth of color); 1 worst rating (large change in depth of color)
[2]Depth of color after washfastness test: 5 best rating (least staining); 1 worst rating (pronounced staining)

25

TABLE 2

Results of inventive and comparative examples for series 2

| No. | Aftertreatment $NaHSO_3$ | NaOH | Other formulation | T [° C.] | Time [min] | Color[1] | Washfastness test Color of test fabrics[2] Wool | Polyamide | Cotton |
|---|---|---|---|---|---|---|---|---|---|
| V9 | — | — | Without aftertreatment | — | — | 5 | — | — | — |
| V10 | — | — | Just water without additives | 70 | 10 | 4-5 | 2-3 | 1-2 | 3 |
| V11 | 1 g/l | 0.2 g/l | — | 40 | 10 | 4 | 2-3 | 1-2 | 3 |
| V12 | 1 g/l | 0.2 g/l | — | 50 | 10 | 4 | 2-3 | 1-2 | 3 |
| V13 | 1 g/l | 0.2 g/l | — | 60 | 10 | 4 | 2-3 | 1-2 | 3 |
| V14 | 1 g/l | 0.2 g/l | — | 70 | 10 | 3-4 | 3 | 2-3 | 3-4 |
| V15 | 1 g/l | 0.2 g/l | — | 70 | 20 | 3 | 3 | 2 | 3 |
| V16 | 2 g/l | 0.4 g/l | — | 40 | 10 | 4 | 2-3 | 1-2 | 3 |
| V17 | 2 g/l | 0.4 g/l | — | 60 | 10 | 4 | 2-3 | 1-2 | 3 |
| V18 | 2 g/l | 0.4 g/l | — | 70 | 10 | 3-4 | 3 | 2-3 | 3-4 |
| V19 | 2 g/l | 0.4 g/l | — | 70 | 20 | 3 | 3 | 2 | 3 |
| V20 | 2 g/l | 0.4 g/l | — | 80 | 10 | 2-3 | 3 | 2-3 | 4-5 |
| V21 | 3 g/l | 1.0 g/l | — | 60 | 10 | 4 | 2-3 | 2 | 4 |
| Inventive 7 | — | — | F1 | 50 | 20 | 4-5 | 2-3 | 2-3 | 4 |
| Inventive 8 | — | — | F1 | 70 | 20 | 4 | 2-3 | 2-3 | 4 |

textile materials of doped polypropylene were used in all tests

The inventive and comparative examples in table 2 show that a conventional aftertreatment with $NaHSO_3$ and NaOH may result in a distinct decolorization of the dyed textile composed of polypropylene fibers depending on the conditions in that the higher the temperature, the longer the time and the greater the concentration of the $NaHSO_3$/NaOH treatment solution, the greater the degree of decolorization. Decolorization is distinctly less with the inventive formulation.

Table 1 summarizes tests, inventive examples and comparative examples with three other dyes and also textiles composed not only of polypropylene but also of PET fibers. The aftertreatment was in each case carried out under the same conditions either with $NaHSO_3$/NaOH or with the formulation to be used according to the present invention. The tests show that the decolorization of the polypropylene textiles in aftertreatment with the inventive formulation is in each case less than in the aftertreatment with $NaHSO_3$/NaOH. Yet the polypropylene textiles aftertreated according to the present invention do not give rise to greater staining in the washfastness test.

We claim:

1. A process for aftertreatment of dyed and/or printed textile materials comprising polyester and/or polypropylene fibers comprising treating said materials with an aqueous formulation of at least one anionic and/or nonionic surfactant (A) at a temperature of 20 to 100° C., wherein the aqueous solution further comprises at least one graft copolymer (B), said graft copolymer (B) comprising a straight-chain or branched, hydrophilic main chain comprising nitrogen and/or oxygen atoms and also side chains grafted thereon, and said graft copolymer (B) comprising at least one selected from the group consisting of (B1) graft copolymers having a main chain consisting essentially of alkylene oxide units and also side chains consisting essentially of ethylenically unsaturated monomers, the main chain having a number average molecular weight $M_n$ of 300 to 60,000 g/mol, and the main chain consisting of ethylene oxide units to an extent of at least 90 mol %, based on the amount of all alkylene oxide units, and the side chains comprising at least 50 mol % of vinyl acetate units, based on the amount of all monomers of the side chains, and (B2) graft copolymers having a main chain consisting essentially of alkyleneimine units and also side chains consisting essentially of polyether units, the main chain having a number average molecular weight $M_n$ of 300 to 10,000 g/mol and the main chain consisting of ethyleneimine units to an extent of at least 90 mol %, based on the amount of all alkyleneimine units, and the side chains comprising polyalkylene oxide groups, the proportion of ethylene oxide and/or of propylene oxide units being at least 90 mol % with regard to the amount of all alkylene oxide units.

2. The process according to claim 1, wherein the aqueous formulation comprises at least one nonionic surfactant (A1) of the general formula $R^1$—O—($CH_2$—CH($R^2$)—O)$_n$—H (I), where the radicals and indices in the formula (I) have the following meanings:

n is a number from 3 to 25, $R^1$ is an aliphatic and/or aromatic, straight-chain or branched hydrocarbyl radical having 8 to 20 carbon atoms, $R^2$ in each occurrence is independently hydrogen or an alkyl radical having 1 to 6 carbon atoms, with the proviso that at least 60 % of the $R^2$ radicals, based on the total number of $R^2$ radicals, comprise hydrogen.

3. The process according to claim 1, wherein the aqueous formulation comprises at least one low-sudsing, nonionic surfactant (A2) of the general formula $R^1$—O—($CH_2$—CH($R^3$)—O)$_m$—$R^4$ (II), where the radicals and indices in the formula (II) have the following meanings:

m is a number from 3 to 30, $R^3$ is hydrogen or an alkyl radical having 1 to 6 carbon atoms, with the proviso that at least 60 % of the $R^3$ radicals, based on the total number of $R^2$ radicals, comprise hydrogen, $R^4$ is a radical selected from the group consisting of straight-chain or branched alkyl radicals having 1 to 20 carbon atoms, groups of the formula —CO—$R^6$, where $R^6$ comprises a straight-chain or branched alkyl radicals having 1 to 20 carbon atoms, and groups of the formula —($CH_2$—CH($R^5$)—O)$_z$—H, where z is a number from 1 to 15 and $R^5$ hydrogen or an alkyl radical having 1 to 6 carbon atoms, with the proviso that at least 60 % of the $R^5$ groups, based on the total number of all $R^5$ groups, comprise an alkyl radical having 1 to 6 carbon atoms.

4. The process according to claim 1, wherein the aqueous formulation comprises at least one foam suppressant (C1).

5. The process according to claim 4, wherein the foam suppressant (C1) comprises polypropylene glycol or a polypropylene glycol derivative.

6. The process according to claim 1, wherein the concentration of said surfactants (A) in the formulation is 0.01 g/l to 5 g/l.

7. The process according to claim 1, wherein the concentration of said graft copolymers (B) in the formulation is 0.5 g/l to 10 g/l.

8. The process according to claim 1, wherein the weight ratio of graft copolymers (B) to surfactants (A) is in the range from 1:1 to 20:1.

9. The process according to claim 2, wherein the formulation comprises at least one surfactant (A1) and at least one low-sudsing surfactant (A2) in a weight ratio of at least 1:1 for low-sudsing surfactants (A2) to total amount of all surfactants.

10. The process according to claim 1, wherein the textile materials comprise polypropylene fibers.

11. The process according to claim 1, wherein the textile materials consist of polypropylene fibers.

12. The process according to claim 10, wherein the polypropylene fibers comprise 1% to 15% by weight of at least one polyester as an additive, the stated weight being based on the amount of all components of the polypropylene fiber.

13. The process according to claim 12, wherein said additive comprises a polyester having a melting point of 50 to 200° C.

14. The process according to claim 12, wherein the polypropylene fibers comprise 0.1% to 10% by weight of at least one block copolymer as a further additive, the block copolymer comprising at least one apolar block having a number average molar mass $M_n$ of at least 200 g/mol constructed essentially of isobutene units, and at least one polar block having a number average molar mass $M_n$ of at least 500 g/mol, constructed essentially of oxyalkylene units.

15. The process according to claim 1, wherein the aftertreatment is carried out at 30 to 90° C.

* * * * *